United States Patent [19]

Kawamata

[11] Patent Number: 4,491,236

[45] Date of Patent: Jan. 1, 1985

[54] CAN END HAVING INTEGRAL OPENING MEANS

[76] Inventor: Kiyoshi Kawamata, 2-337 Takahana Chō, Ohmiya City, Saitama Prefecture, Japan

[21] Appl. No.: 335,272

[22] Filed: Dec. 28, 1981

[30] Foreign Application Priority Data

Jun. 29, 1981 [JP] Japan ..... 56-96488

[51] Int. Cl.[3] ..... B65D 17/34

[52] U.S. Cl. ..... 220/269

[58] Field of Search ..... 220/269-273

[56] References Cited

U.S. PATENT DOCUMENTS

| | | | |
|---|---|---|---|
| 3,204,812 | 9/1965 | Henchert | 220/272 |
| 3,442,416 | 5/1969 | Nicholson | 220/269 |
| 3,717,279 | 2/1973 | Patarini et al. | 220/269 |
| 3,762,597 | 10/1973 | Kaminski et al. | 220/270 |
| 3,877,606 | 4/1975 | Silver | 220/269 |
| 4,096,967 | 6/1978 | Kaminski | 220/269 |

FOREIGN PATENT DOCUMENTS

| | | | |
|---|---|---|---|
| 2749351 | 1/1979 | Fed. Rep. of Germany | 220/269 |

*Primary Examiner*—George T. Hall

*Attorney, Agent, or Firm*—Wenderoth, Lind & Ponack

[57] ABSTRACT

A can with a can end plate provided with an opening score having a discontinuity at the center of the can end plate. A finger retainer tab is fixed to the scored region of the can end plate. The end portion of the finger retainer tab located at one side of the fixing portion constitutes a projectable portion which is projectable into the can during opening of the latter, while the other end located at the other side of the fixed portion constitutes a finger retainer portion. Projections serveable as a fulcrum are formed to project laterally outwardly from both side edges of the finger retainer tab so as to extend across the lines of the score. The can end plate is further provided with reinforcement ribs formed along linear side portions and discontinuity of the score. The terminating ends of the linear side portions of the score, determining the discontinuity, are bent toward or away from each other.

9 Claims, 8 Drawing Figures

CAN END HAVING INTEGRAL OPENING MEANS

BACKGROUND OF THE INVENTION

1. Field of the Invention

The present invention relates to a can and, more particularly, to a can having a can end plate provided with an opening score along which the can end plate is openable and a finger retainer tab by which the scored region of the can end plate is pulled for opening.

2. Description of the Prior Art

Such a can has been known as having a can end plate provided with an opening score formed therein and a finger retainer tab fixed usually at one of its ends to the portion of the can end plate surrounded by the score. In these known cans, the score is formed in a complete annular form so that the region surrounded by the score (referred to as "scored region", hereinafter) of the can end plate with the finger retainer tab is perfectly severed from the other region of the can end plate. The severed piece of can end plate with the finger retainer tab attaching thereto often causes unexpected accidents.

SUMMARY OF THE INVENTION

Accordingly, an object of the invention is to provide a can in which the scored region of the can end plate with the finger retainer tab attaching thereto is not severed completely from the can end plate after opening thereof.

To this end, according to the invention, there is provided a can having a can end plate provided with an opening score and a finger retainer tab fixed at one of its ends to the scored region, the part of the finger retainer tab at one side of the fixing portion of the finger retainer tab is projectable into the can while the part at the other side of the fixing portion constitutes a finger retaining portion, the finger retaining tab being provided at its outer edge portion near the fixing portion thereof with a projection adapted to serve as a fulcrum, the can end plate being further provided with a reinforcement rib along the score, the discontinuities of the score being curved toward or away from each other.

These and other objects, features and advantages of the invention will become clear from the following description of the preferred embodiment taken in conjunction with the accompanying drawings.

DESCRIPTION OF THE PREFERRED EMBODIMENTS

Figure 1:
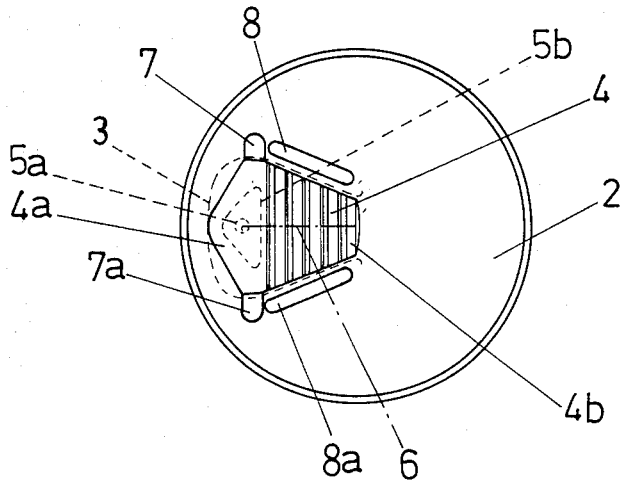
FIG. 1 is a plan view of a can in accordance with an embodiment of the invention.

Referring to the drawings, a can end plate 2 is secured by curling to the upper end of a can body 1. A score 3 for facilitating the opening of the can end plate 2 is formed in the reverse side of the can end plate 2 as shown in FIG. 1. The score 3 has an arcuate end portion adjacent to the peripheral edge of the can end plate 2 and a substantially linear portions extending from both ends of the arcuate end portion. The distance between two linear portions becomes smaller toward the center of the can end plate 2. The other ends of these linear portions terminate in the central portion of the can end plate. Namely, the score 3 has a discontinuity in the central portion of the can end plate 2. To the scored region of the can end plate 2, a finger retainer tab 4 is attached by means of a projection 5 such that one end of the finger retainer tab 4 is located at the inner side of the arcuate end portion of the score 3. The projection 5 has an attaching portion **5*a*, and is provided with a straight edge 5*b* which extends substantially at a right angle to a line 6 interconnecting the center of the can end plate 2 and the center of the attaching portion 5*a*. The straight edge 5*b* is located at the same side of the attaching portion 5*a* as the center of the can end plate 2**.

The end portion of the finger retainer tab 4 adjacent to the peripheral edge of the can end plate 2 constitutes a projectable portion **4*a* projectable into the can when the latter is opened, while the other end portion adjacent to the can end plate 2 constitutes a finger retaining portion 4*b*. The finger retainer tab 4 is so sized and shaped that the outer extremity of the projectable portion 4*a* is located substantially within the scored region, although this outer extremity may slightly lap the arcuate portion of the score 3**.

As will be best seen from FIG. 1, lateral projections **7,7*a* are formed to project from the portions of the finger retainer tab 4 where the side edges of the finger retaining portion 4*b* are connected to both ends of the projectable portion 4*a*, so as to extend across respective side portions of the score 3. These projections 7,7*a* serve as a fulcrum when the finger retainer tab 4 is pulled for opening the can end plate 2. As will be seen from FIGS. 1, 2, 3 and 6, ribs 8 and 8*a* in the form of protrusions or recesses are provided in the portion of the can end plate 2 at the outer sides of the linear side portions of the score 3 so as to extend along these linear side portions. Also, a rib 8*b* in the form of a protrusion or a recess is formed at the inner side of the discontinuity of the score 3, so as to extend substantially at a right angle to the aforementioned line 6. These ribs 8,8*a* and 8*b* effectively reinforce the edges of the opening of the can end plate 2. Particularly, the rib 8*b* determines the base portion of a partially severable portion 12 of the can end plate 2 and facilitates the folding of the same portion 12** after the severance.

Figure 7:
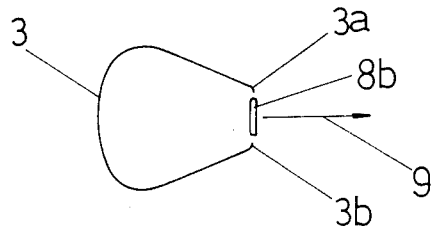
FIGS. 7 and 8 are schematic illustrations of shapes of scores formed in the reverse side of the can end plate.
Figure 8:
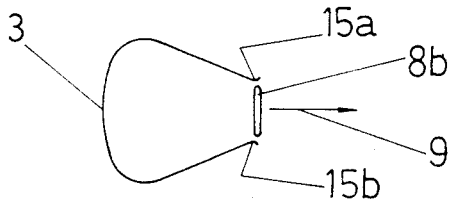

FIG. 7 shows an example of the configuration of the score 3. In this case, both ends **3*a* and 3*b* of the discontinuity, i.e. the terminating ends of the linear side portions of the score 3, are slightly curved toward each other. Alternatively, as designated at reference numerals 15,15*a*, these ends may be curved away from each other. These curvatures of the terminating ends of the linear side portions of the score effectively prevent the partially separable portion 12 from being torn in the direction of the arrow 9**.

Figure 2:
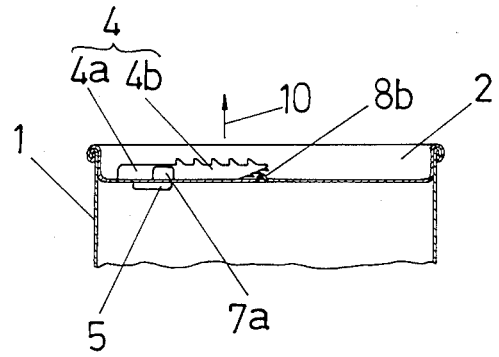
FIG. 2 is a vertical sectional elevational view of the can as shown in FIG. 1.
Figure 3:
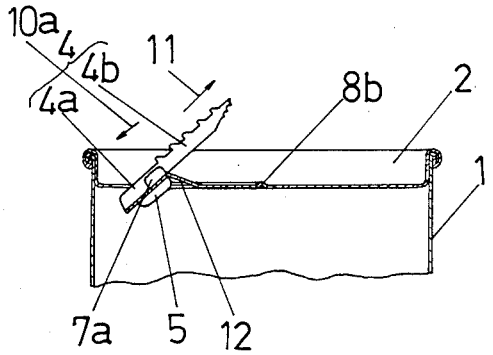
FIG. 3 is a vertical sectional elevational view of the can with a part of a finger retainer tab lifted.
Figure 4:
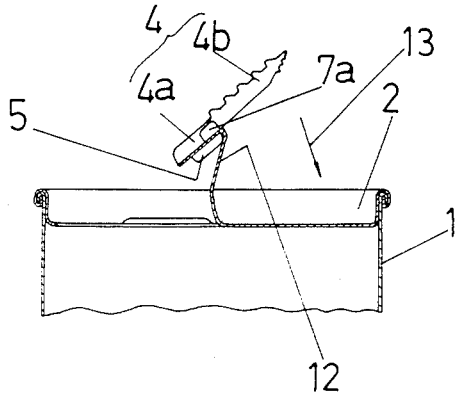
FIG. 4 is a vertical sectional elevational view of the can from which a scored region of the can end plate together with the finger retainer tab has been partly severed.
Figure 5:
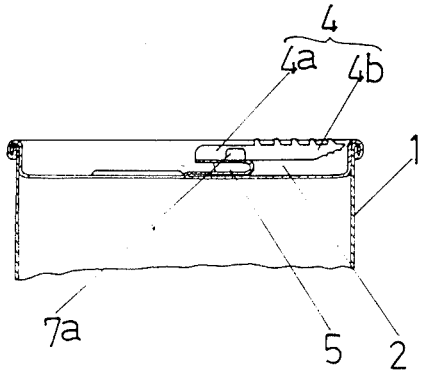
FIG. 5 is a vertical sectional elevational view of the can with the partly severed scored region with the finger retainer tab in a folded state.
Figure 6:
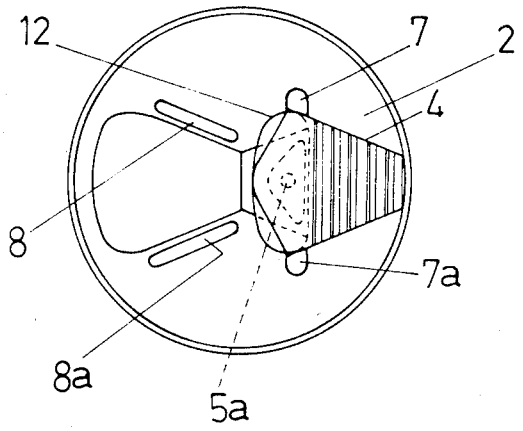
FIG. 6 is a plan view of the can in the state shown in FIG. 5.

For opening the can end plate 2, the finger retainer portion 4*b* of the finger retainer tab 4 is pulled and lifted in the direction of the arrow 10 in FIG. 2, so that the finger retainer tab 4 is rotated around the projections 7,7*a* which serve as a fulcrum as mentioned above, so that the projectable portion 4*a* (See FIG. 3) is projected into the can while breaking a portion of the score 3. Then, as the finger retainer tab 4*b* is lifted obliquely upwardly as indicated by arrow 11, the partially severable portion 12 is severed as shown in FIG. 4 precisely along the score 3. The partially severed portion 12 is then bent back around the straight edge 5*b* of the projection 5. Therefore, by pressing the partially severed portion 12 downwardly as indicated by an arrow 13, it is folded back into a flat form as shown in FIG. 5.

If the finger retainer tab 4 is sized and shaped such that the finger retainer tab 4 after the folding back does not extend beyond the peripheral edge of the can end plate 2, it is possible to depress and hold the tab 4 and partially severed portion 12 at a level below the upper end brim of the can end plate 2 as will be seen from FIG. 5. This feature is quite advantageous from the view point of safety and handling.

The attaching of the finger retainer tab 4 to the can end plate 2 may be made in various ways. For instance, the finger retainer tab 4 may be formed by an injection molding in such a manner that the injected material fills a tab attaching hole formed beforehand in the can end plate. Alternatively, the attaching portion 5*a* is inserted into the tab attaching hole and then shaped into the form as illustrated by applying heat under a pressure.

In the can according to the invention, the partially severed portion 12 and the finger retainer tab 4 do not fall into the can during the opening, because the lateral projections 7,7*a* of the finger retainer tab 4 extend across the lines of the score 3. In addition, the initial breaking of the score 3 can be made quite easily because the projectable portion 4*a* is located within the scored region. Furthermore, since the terminating ends of the linear side portions of the score defining the discontinuity are curved toward or away from each other as at 3*a*,3*b* and 15*a*,15*b*, the partially severed portion is never torn off from the can end plate even if it is pulled strongly.

Although the invention has been described through specific forms, it is to be noted here that the described embodiments are not exclusive and various changes and modifications may be imparted thereto without departing from the spirit and scope of the invention which are limited solely by the appended claims.

What is claimed is:

1. A container comprising:

a container body;

an end plate closing an end of said container body, said end plate having a score line defining an elongated tear strip having a first end and a second end opposite said first end, said score line including first and second score line side portions which are joined at said first end of said strip and are free at said second end of said strip;

a finger retainer tab located outward of said container body, having a projectable portion, a finger retainer portion and a fixing portion, said fixing portion being located between said projectable portion and said finger retainer portion, said finger retainer tab being fixed to said elongated strip at said fixing portion, said finger retainer tab being manually pivotable outward at said finger retainer portion away from said container body and inward at said projectable portion such that said projectable portion projects into said container body so as to tear said strip along said score line at said first end when said finger retainer portion is lifted outward;

first and second projection members extending in opposite directions from said finger retainer tab between said finger retainer portion and said projectable portion respectively laterally across said first and second score line side portions outward of said container body, said first and second projection members being sufficiently rigid as to remain outward of said container body and function as a fulcrum when said finger retainer tab is pivoted by lifting outward on said finger retainer portion, whereby said projectable portion projects into said container body to tear said strip;

said end plate having first and second reinforcement ribs respectively along said first and second score line side portions and a third reinforcement rib extending between said first and second reinforcement ribs and spaced from said first and second score line side portions at said second end; and a third projection member extending from said tear strip of said end plate inward of said container body opposite said fixing portion of said finger retainer tab, having an inwardly projecting straight edge between said fixing portion and said finger retainer portion extending between said first and second score line side portions to facilitate folding of said tear strip thereover by pulling the finger retainer tab obliquely outward and against the remainder of said end plate after said tear strip has been torn along said score line.

2. A container as claimed in claim 1, wherein said first, second and third reinforcement ribs are formed as protrusions.

3. A container as claimed in claim 1, wherein said first, second and third reinforcement ribs are formed as recesses.

4. A container as claimed in claim 1, wherein said first and second score line side portions include linear side portions converging from the outer peripheral edge of said end plate toward the center of said end plate, the convergent ends of said linear portions extending into the free ends of said first and second score line side portions, said free ends being curved toward each other.

5. A container as claimed in claim 1, wherein said first and second score line side portions include linear side portions converging from the outer peripheralportion of said end plate toward the center of said end plate, the convergent ends of said linear side portions extending into the free ends of said first and second score line side portions, said free ends being curved away from each other.

6. A container as in claim 1, wherein first and second score line side portions respectively include third and fourth substantially straight score line side portions, said first and second reinforcement ribs respectively extending along the entire lengths of said third and fourth score line side portions, said third and fourth score lines side portions converging at an angle, said third reinforcement rib extending along a first line at a right angle to a second line which bisects said angle.

7. A container as in claim 1, wherein said tear strip has a hole therein, said finger retainer tab and said third projection member constituting an integrally formed member which extends through said hole and is heated sealed to said tear strip.

8. A container as claimed in claim 1, wherein said third projection has a triangular cross section in a plane parallel to said end plate.

9. A container as in claim 6, wherein said first and second projection members extending in directions substantially parallel said first line.

* * * * *